US005447344A

United States Patent [19]

Hayward

[11] Patent Number: 5,447,344

[45] Date of Patent: Sep. 5, 1995

[54] ELECTRONIC SEAL

[75] Inventor: Gilbert O. Hayward, Amroth, Wales

[73] Assignee: Encrypta Electronics Limited, Newport, Wales

[21] Appl. No.: 219,364

[22] Filed: Mar. 29, 1994

[30] Foreign Application Priority Data

Mar. 29, 1993 [GB] United Kingdom ..... 9306463

[51] Int. Cl.[6] ..... E05C 19/10

[52] U.S. Cl. ..... 292/246; 292/307 R; 292/329

[58] Field of Search ..... 292/246, 248, 321, 320, 292/328, 329, 307 R, 307 B

[56] References Cited

U.S. PATENT DOCUMENTS

| | | | |
|---|---|---|---|
| 3,072,986 | 1/1963 | Lefnack | 292/307 R |
| 3,770,307 | 11/1973 | Van Grompel | 292/307 R |
| 4,183,566 | 1/1980 | Yates | 292/329 |
| 4,747,631 | 5/1988 | Loynes et al. | 292/307 R |
| 4,995,656 | 2/1991 | Akashi | 292/307 R |
| 5,119,652 | 6/1992 | Costa | 292/307 R |
| 5,181,402 | 1/1993 | Faessler et al. | 292/307 B |
| 5,195,791 | 3/1993 | Hu | 292/246 |

FOREIGN PATENT DOCUMENTS 0193297 9/1986 European Pat. Off. .

*Primary Examiner*—Peter M. Cuomo
*Assistant Examiner*—Monica E. Millner
*Attorney, Agent, or Firm*—Browdy and Neimark

[57] ABSTRACT

An electronic seal comprises a housing (12), a cord (14) with one end fixed to the housing (12) and a free end which can be passed through a door catch or the like and releasably connected to the housing (12), an electronic circuit within the housing (12) arranged to generate one of a number of unique codes when a switch (70) in the housing (12) is actuated on connection or disconnection of the cord (14) to or from the housing (12) and a display device (18) which can display the unique code. The cord (14) has a series of regularly spaced enlargements (36), and the interior of the housing (12) has a plurality of teeth (40) arranged so that when a length of cord (14) at its free end is inserted into the housing (12) the enlargements (36) can fit between the teeth (40) to hold the cord (14) against withdrawal from the housing (12). A slide (16) is movable in the housing (12) between an open position in which the cord (14) can be inserted into and withdrawn from the housing (12) and a locking position in which it retains the enlargements (36) in engagement with the teeth (40). The switch (70) has an actuating member (72) projecting into the space between two of the teeth (40), so that the switch is actuated when the length of cord (14) is moved into or out of engagement with the teeth (40). The fixed end of the cord (14) is connected permanently to the housing (12) by engagement of enlargements (36) on the cord (14) with a further set of teeth in the housing (12). The cord (14) is held in engagement with the further teeth by the slide (16), when the slide (16) is in the open or locking position. The slide (16) is movable from a third position in which the fixed end of the cord (14) can be inserted into the housing (12) before the seal is first used, but is then prevented from being moved back to the third position.

16 Claims, 4 Drawing Sheets

ELECTRONIC SEAL

Figure 1:
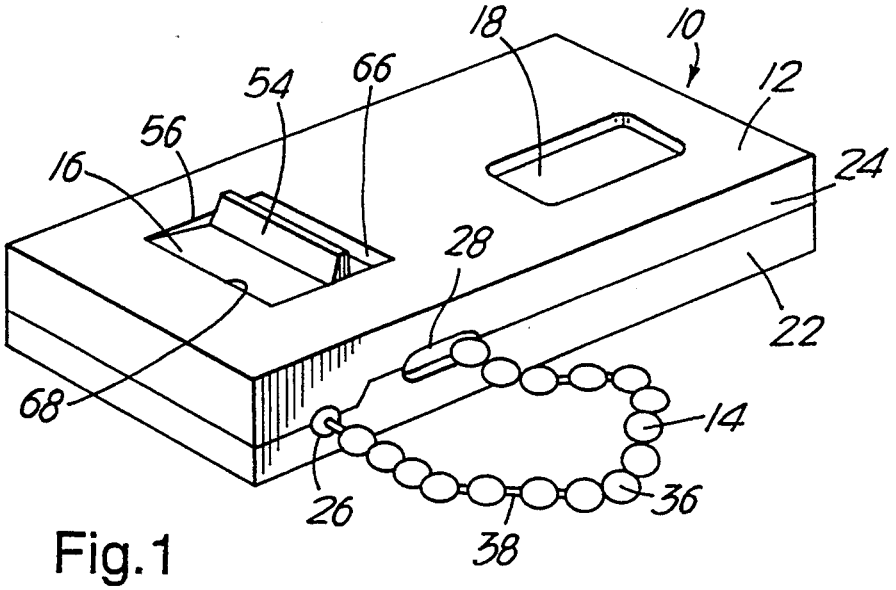

This invention relates to electronic seals.

More particularly, the invention relates to an electronic seal comprising a housing, a flexible element extending from the housing and having a free end which can be passed through a door catch or the like, means for releasably connecting the free end of the flexible element to the housing, an electronic circuit within the housing arranged to generate one of a number of unique codes on receipt of an electrical signal and to store the generated code, display means on the housing adapted to display the generated code, and a switch in the housing actuated on connection and/or disconnection of the flexible element to the housing to provide an electrical signal to actuate the electronic circuit.

European patent 0 193 297 describes such a seal, designed principally for use with goods vehicles or freight containers. The specific embodiment described in the patent has a housing adapted to be fixed to the exterior of the door or shutter of the vehicle or container, and a flexible cable, e.g. of multi-stranded wire, permanently fixed at one end to the housing and having at its free end a head which fits into a recess of the housing and which is trapped in the recess by a movable catch member on the housing. A switch coupled to the catch member provides a signal to the electronic circuitry in the housing when the catch member is moved to lock the head of the cable in the recess. The described seal is of robust construction and has a relatively long life, and therefore is particularly suitable for use with goods vehicles or freight containers. It is not however particularly suitable for uses where a small and inexpensive seal is required, for example, in the airline industry, where small disposable seals are used to secure bonded goods on aircraft, such as bar boxes and high value items for purchase by passengers in flight.

It is an object of this invention to provide an electronic seal which can be made small and relatively inexpensive.

In accordance with one aspect of this invention, there is provided an electronic seal of the kind set forth, in which the flexible element is a cord having a series of regularly spaced enlargements, and the means for releasably connecting the free end of the cord to the housing comprises a passage in the housing into which a length of the cord can be inserted, a plurality of teeth in the housing adapted to fit between enlargements of the cord, so that when the length of cord is inserted into the housing each enlargement of the length can fit between two adjacent teeth to hold the cord against withdrawal from the housing, and a slide movable in the housing between a position in which the cord can be inserted and removed from the passage, and a position in which the slide retains the enlargements in engagement with the teeth, and the switch has an actuating member projecting into the space between two of the teeth, so as to be engaged by one of the enlargements on the cord when it is engaged between the teeth, so that the switch is actuated with the length of cord is moved into and/or out of engagement with the teeth.

Preferably, the flexible element comprises a series of balls of plastics moulded onto a plastics cord to form the enlargements. For example, the flexible element may be of the known type consisting of plastic balls moulded onto a braided nylon cord and known as a "ball chain".

In accordance with another aspect of this invention, the fixed end of the flexible element is retained in the housing by engagement of the enlargements on a length of the element at the fixed end with a further set of teeth formed on the slide, the further set of teeth engaging the enlargements when the slide is in each of the said two positions, and the slide being movable to a third position in which the teeth on the slide are withdrawn from engagement with the flexible element, so that the flexible element can be inserted into the housing.

Figure 2:
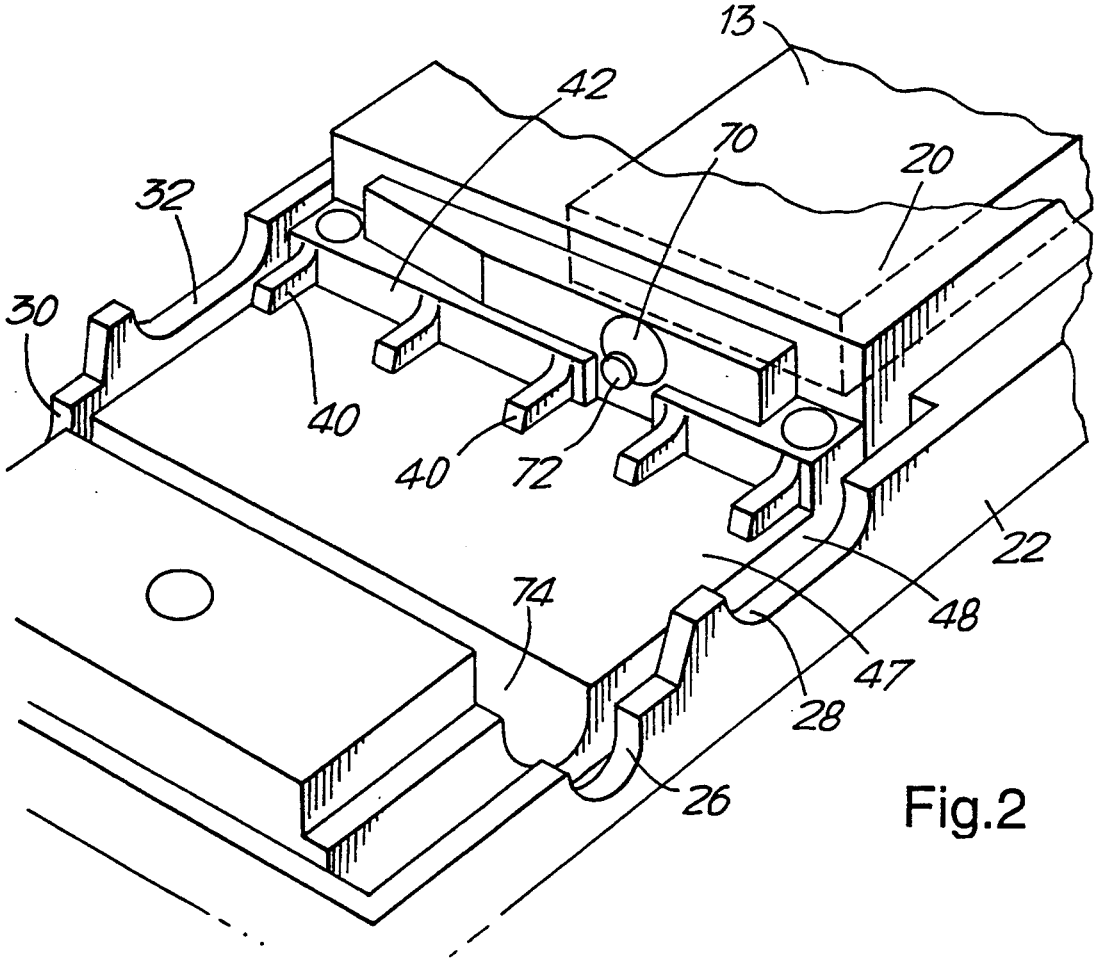
Figure 3:
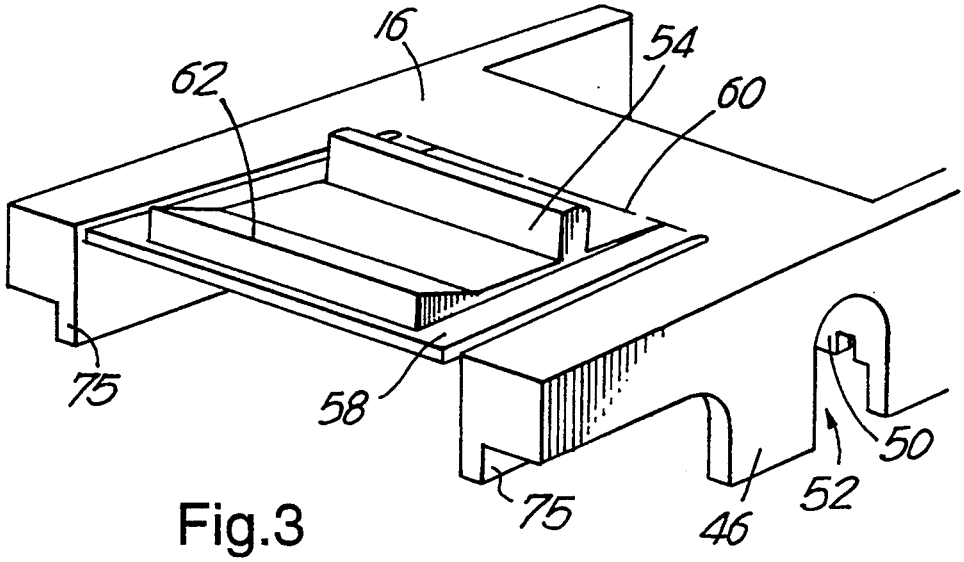
Figure 4:
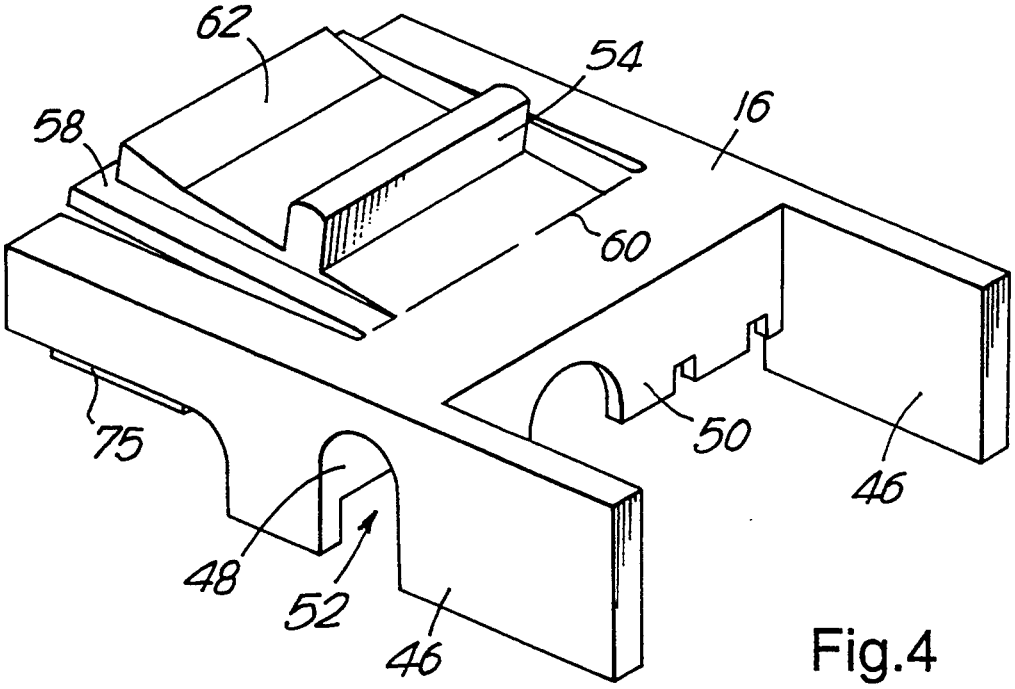
Figure 5:
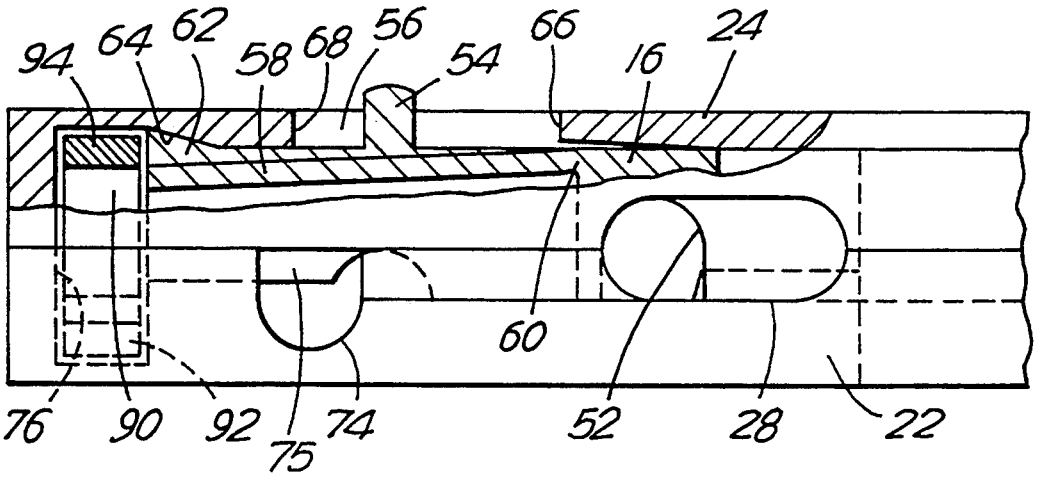
Figure 6:
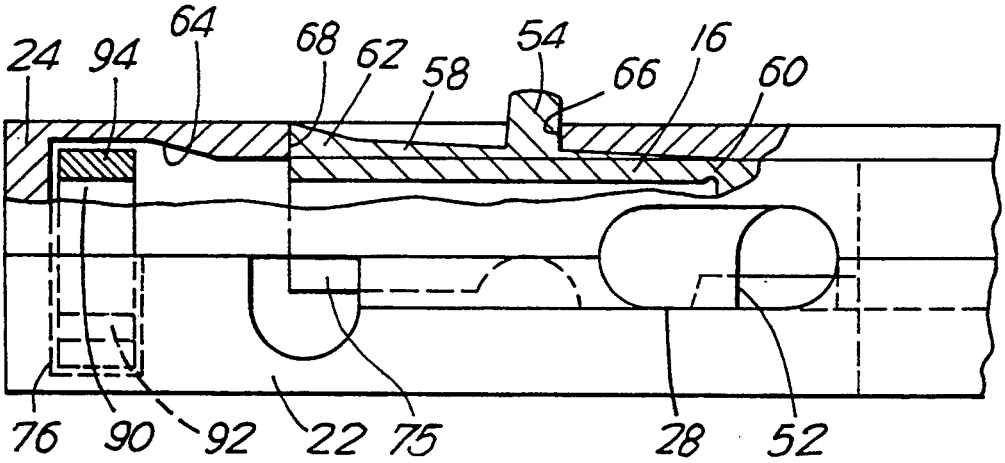
Figure 7:
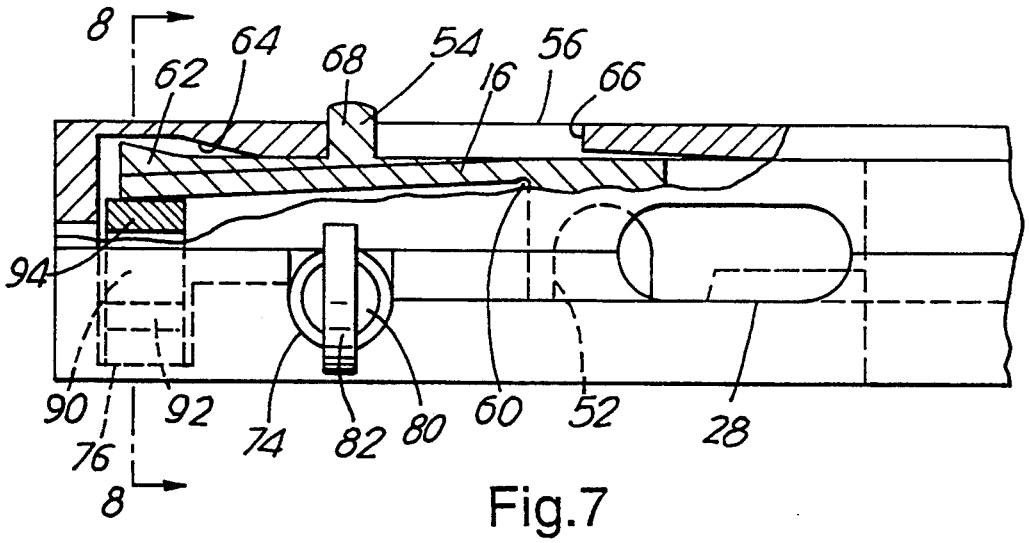
Figure 8:
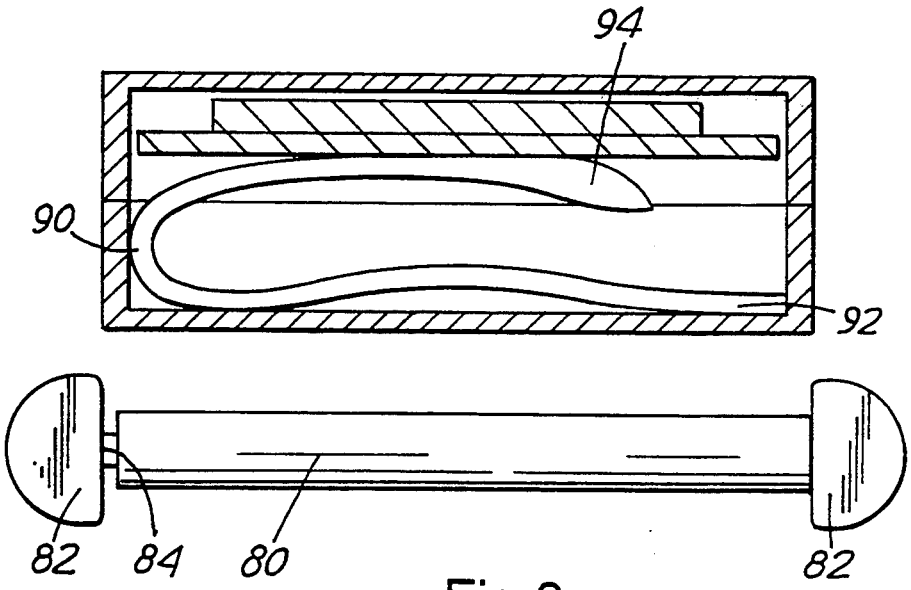

The invention will now be described, by way of example, with reference to the accompanying drawings, in which:

FIG. 1 is an isometric view of an electronic seal in accordance with the invention, FIG. 2 is a fragmentary isometric view of the lower part of the housing of the seal, FIG. 3 is an isometric view of a slide of the seal, FIG. 4 is an isometric view of the slide from a different direction, FIG. 5 is a diagrammatic side elevation, partly in section, of the housing and slide, showing the slide in the open position, FIG. 6 is a view similar to FIG. 5, showing the slide in the closed position, FIG. 7 is a view similar to FIGS. 5 and 6, showing the slide in position to receive the permanently fixed end of the cord, and FIG. 8 is a cross-section on line 8—8 of FIG. 7.

Referring to the drawings, an electronic seal 10 comprises a housing 12, a flexible element in the form of a cord 14 fixed at one end to the housing and at the other end releasably connected to the housing, and a slide 16 operable to release the free end of the cord 14 from the housing 12.

The housing 12 contains electronic circuitry 13 which is arranged to generate and store a pseudo-random number each time a switch is operated by movement of the slide to entrap or release the free end of the cord 14, as described below. The housing includes a display 18 (e.g. a liquid crystal display) on which the stored number can be displayed. The electronic circuitry can also be arranged to provide other information, for example the time at which each operation of the switch occurs. Electronic circuitry for carrying out such functions is known, and so will not be described further. The electronic circuitry is contained in a sealed module 20 fixed within the housing. The module contains the display and also a battery to power the electronic circuitry.

The cord 14 consists of a series of plastic balls 36 moulded at regular intervals onto a braided nylon cord 38.

The housing 12 consists of a lower part 22 and an upper part 24, each moulded from suitable plastics. The two parts are connected together by means of an upstand (not shown) on the lower part 22 fitting snap-wise into the upper part 24. The right hand portion of the housing as seen in FIG. 1 contains the electronic module 20. The other portion of the housing contains the mechanism for connecting the cord 14 to the housing. On one side of the housing a circular aperture 26 is provided to receive the permanently fixed end of the cord 14. An elongate aperture 28 is provided to receive the releasable end of the cord 14. Similar apertures 30 and 32 (FIG. 2) are formed on the other side of the housing.

The lower part 22 of the housing 12 has a series of teeth 40 projecting from a vertical face 42 of the housing near to the module 20 and lying against a lower horizontal face 44 of the housing. The teeth 40 are spaced apart with the same spacing as the balls 36 of the cord 14, so that the teeth define between them pockets to receive four of the balls 36. The teeth are dimensioned to fit between adjacent balls and beneath the cord 38.

The slide 16 has rails 46 which engage in runways 47 in the lower part 22 of the housing, so that the slide can move horizontally towards and away from the face 42. The slide has two downwardly extending walls 48 and 50 which define between them a passage 52 to receive a length of the cord 14. When the slide is in the "open" position as shown in FIG. 5, the passage 52 is adjacent to the left-hand end of the elongate aperture 28, so that cord can be freely inserted into the passage through the aperture 28. Movement of the slide 16 to the "closed" position shown in FIG. 6, carries the length of cord into engagement with the teeth 40, so trapping the chain in position.

The slide 16 is movable by means of a bar 54 which projects upwards through an aperture 56 formed in the upper part 24 of the housing, so that the bar can be gripped by the user's fingers. The bar 54 is formed on a rectangular grip portion 58 connected to the body of the slide 16 by an integral hinge 60, so that the portion 58 is spring-biased upwards. When the slide 16 is moved to the "open" position shown in FIG. 5, a detent 62 formed at the end of the grip portion 58 is moved by the spring action into engagement in a recess 64 formed in the upper part 24 of the housing. When the slide 16 is moved to the "closed" position shown in FIG. 6, the bar 54 engages one side 66 of the aperture 56, and the detent 62 springs upwards to engage the other side 68 of the aperture, to hold the slide in position until it is released by depressing the bar 54.

Forming part of the electronic module 20 is a microswitch 70 having all operating pip 72 which projects into the space between two of the teeth 40, so that the pip 72 is engaged by one of the balls 36 on cord 14 as it is moved into engagement with the teeth 40.

The end of the cord 14 permanently attached to the housing is retained as follows. A length of the cord extends through a groove 74 formed in the lower part 22 of the housing and extending between the apertures 26 and 30 at each side of the housing. A set of teeth 75 formed on the underside of the slide 16 engage between adjacent balls of the length of cord to hold it in position. The teeth 75 engage the cord in both the "open" and "closed" positions of the slide as shown in FIGS. 5 and 6.

The seal is supplied to the user with a suitable length of the cord 14 detached from the body of the seal, so that the user can choose the side of the seal from which to insert the cord. The seal is assembled by the manufacturer with the module 20 in place in the lower part 22 of the housing 12, with a disposable plastic peg 80 laid in the groove 74. A plastics leaf spring 90 is laid in a groove 76 formed in the lower part 22 of the housing. The spring 90 has a lower portion 92 which bears against the floor of the groove 76, and an upper portion 94 which is biased upwards by the resilience of the spring. The slide 16 is placed with its detent 62 positioned above the leaf spring 90 as shown in FIG. 7, and with a groove (not shown) in the underside of the slide fitting over the peg 80. The upper part 24 of the housing 12 is then snapped into place, causing the end of the slide 16 to depress the spring 90 as shown in FIG. 7. The engagement of pin 80 in the groove in the slide 16 locks the slide in position. The pin 80 has two paddle shaped enlarged ends 82 which retain it in position in the housing. Pin 80 is formed with a waisted portion 84. The seal is supplied to the customer in this condition, together with a suitable length of cord.

To insert the "permanently" connected end of the cord 14 to the housing, the user twists the enlarged ends 82 of the peg 80 to break it at the waisted portion 84, so that the peg can be removed. The cord 14 can then be inserted into groove 74, through aperture 26 or aperture 30 until at least one ball 36 emerges from the other aperture. The slide 16 is then moved to the "open" position as shown in FIG. 5, trapping the cord 14 in the housing. Movement of the slide 16 to the open position allows the upper part 94 of the leaf spring 90 to move upwards past the end of the slide 16, to the position shown in FIGS. 5 and 6, preventing any return movement of the slide 16. The cord 14 is thus permanently trapped in the housing and cannot be removed except by destroying the seal.

In use of the seal, one end of the cord 14 is "permanently" fixed to the housing by the user as described above. When the box or container to be sealed is closed, the free end of the cord 14 is threaded through a catch on the lid of the box and, with the slide 16 in the "open" position, is inserted through aperture 28 into the housing. The slide 16 is then moved to the "closed" position, trapping the chain in the housing. Movement of the length of chain in the housing into engagement with the teeth 40 causes one of the balls 36 to engage the actuating pip 72 to operate the microswitch 70. This provides a signal to the electronic circuitry, causing generation of a pseudo-random random which is stored and displayed on the display 18. A user can then make a record of the displayed number. Before the box is next opened, the user can check that the display 18 displays the same number. Any unauthorised movement of the slide 16 to release the cord 14 will cause actuation of the switch 17, to generate a new pseudo-random number and, if appropriate, to record the time of actuation of the switch.

The described seal is relatively simple to manufacture, and can be made inexpensively. Cord of the kind used is readily available, and is relatively strong for its dimensions. The use of a single slide to retain both the "permanently" fixed end of the cord and the releasable end of the cord simplifies the construction and operation of the seal. The method of trapping the ends of the cord enable both ends to be inserted from either side of the seal, to suit particular applications.

It will be appreciated that modifications could be made in the described embodiment. For example, an additional latching mechanism could be provided to prevent inadvertent release of the slide 16 from its closed position. A suitable mechanism might consist of two detents carried by the slide 16 and spring-loaded to project through respective apertures in the wall of the housing 12, when the slide 16 is in its closed position, so that the slide cannot be released by pressing down the bar 54 unless the detents are simultaneously depressed to move them out of engagement with the apertures in the housing.

I claim:

1. An electronic seal comprising a housing, a flexible element extending from the housing and having a free end which can be passed through a door catch means for releasably connecting the free end of the flexible element to the housing, an electronic circuit within the housing arranged to generate one of a number of unique codes on receipt of an electrical signal and to store the generated code, display means on the housing adapted to display the generated code, and a switch on the housing actuated on connection or disconnection of the flexible element to the housing to provide an electrical signal to actuate the electronic circuit, in which the flexible element is a cord having a series of regularly spaced enlargements, and the means for releasably connecting the free end of the cord to the housing comprises a passage in the housing into which a length of the cord can be inserted, a plurality of teeth in the housing adapted to fit between enlargements of the cord, so that when the length of cord is inserted into the housing each enlargement of the length of cord can fit between two adjacent teeth to hold the cord against withdrawal from the housing, and a slide movable in the housing between a first position in which the cord can be inserted and removed from the passage, and a second position in which the slide retains the enlargements in engagement with the teeth, and the switch has an actuating member projecting between two of the teeth, so as to be engaged by one of the enlargements on the cord when it is engaged between the teeth, so that the switch is actuated when the length of cord is moved into or out of engagement with the teeth.

2. An electronic seal as claimed in claim 1, in which the flexible element comprises a series of balls of plastic moulded onto a plastic cord to form the enlargements.

3. An electronic seal as claimed in claim 1 in which the housing is a rectangular parallelepiped, and the passage extends between openings in two opposite side walls of the housing, so that the flexible element can be inserted from either side of the housing.

4. An electronic seal as claimed in claim 3, in which the passage is formed between a first wall extending between the side walls of the housing and a second wall formed on the slide, the teeth projecting from the first wall, so that on movement of the slide from the first to the second position, the second wall can engage the enlargements of the flexible element to move them into engagement with the teeth.

5. An electronic seal as claimed in claim 1, in which the slide has an arm formed with a detent which is resiliently biased to move into engagement with an abutment surface on movement of the slide to the second position, the engagement holding the slide in the second position, and the arm being movable manually to move the detent out of engagement with the abutment surface to allow it to be moved from the second position.

6. An electronic seal as claimed in claim 5, in which the arm has a grip portion which projects through an opening in the housing and which can be gripped by the user to enable the arm to be moved to release engagement of the detent from the abutment surface and to enable the slide to be moved between the first and second positions.

7. An electronic seal comprising a housing, a flexible element extending from the housing and having a free end which can be passed through a door catch, means for releasably connecting the free end of the flexible element to the housing, an electronic circuit within the housing arranged to generate one of a number of unique codes on receipt of an electrical signal and to store the generated code, display means on the housing adapted to display the generated code, and a switch on the housing actuated on connection or disconnection of the flexible element to the housing to provide an electrical signal to actuate the electronic circuit, in which the flexible element is a cord having a series of regularly spaced enlargements, and the means for releasably connecting the free end of the cord to the housing comprises a passage in the housing into which a length of the cord can be inserted, a plurality of teeth in the housing adapted to fit between enlargements of the cord, so that when the length of cord is inserted into the housing each enlargement of the length of cord can fit between two adjacent teeth to hold the cord against withdrawal from the housing, and a slide movable in the housing between a first position in which the cord can be inserted and removed from the passage, and a second position in which the slide retains the enlargements in engagement with the teeth, and the switch has an actuating member projecting between two of the teeth, so as to be engaged by one of the enlargements on the cord when it is engaged between the teeth, so that the switch is actuated when the length of cord is moved into or out of engagement with the teeth, and in which the fixed end of the flexible element is retained in the housing by engagement of the enlargements on a length of the flexible element at the fixed end of the flexible element with a second set of teeth formed on the slide, the second set of teeth engaging the enlargements when the slide is in each of the said first and second positions, and the slide being movable to a third position in which the teeth on the slide are withdrawn from engagement with the flexible element, so that the flexible element can be inserted into the housing; and in which the housing has a second passage to receive the length of flexible element at the fixed end when it is engaged with the second set of teeth, the further passage extending between openings in two opposite side walls of the housing, so that the flexible element can be inserted from either side of the housing.

8. An electronic seal as claimed in claim 7, in which there is provided in the housing a spring-loaded locking element which bears against the slide when the slide is in the third position and which, on movement of the slide away from the third position after insertion of the fixed end of the flexible element, moves to a position in which it prevents movement of the slide back to the third position.

9. An electronic seal as claimed in claim 2, in which the housing is a rectangular parallelepiped, and the passage extends between openings in two opposite side walls of the housing, so that the flexible element can be inserted from either side of the housing.

10. An electronic seal as claimed in claim 9, in which the slide has an arm formed with a detent which is resiliently biased to move in engagement with an abutment surface on movement of the slide to the second position, the engagement holding the slide in the second position, and the arm being movable manually to move the detent out of engagement with the abutment surface to allow it to be moved from the second position.

11. An electronic seal as claimed in claim 4, in which the slide has an arm formed with a detent which is resiliently biased to move in engagement with an abutment surface on movement of the slide to the second position, the engagement holding the slide in the second position, and the arm being movable manually to move the detent out of engagement with the abutment surface to allow it to be moved from the second position.

12. An electronic seal as claimed in claim 10, in which the arm has a grip portion which projects through an opening in the housing and which can be gripped by the user to enable the arm to be moved to release engagement of the detent from the abutment surface and to enable the slide to be moved between the first and second positions.

13. An electronic seal as claimed in claim 13, in which the fixed end of the flexible element is retained in the housing by engagement of the enlargements on a length of the flexible element at the fixed end of the flexible element with a further set of teeth formed on the slide, the further set of teeth engaging the enlargement when the slide is in each of the said first and second positions, and the slide being movable to a third position in which the teeth on the slide are withdrawn from engagement with the flexible element, so that the flexible element can be inserted into the housing.

14. An electronic seal as claimed in claim 13, in which there is provided in the housing a spring-loaded locking element which bears against the slide when the slide is in the the third position and which, on movement of the slide away from the third position after insertion of the fixed end of the flexible element, moves to a position in which it prevents movement of the slide back to the third position.

15. An electronic seal as claimed in claim 7, in which there is provided in the housing a spring-loaded locking element which bears against the slide when the slide is in the the third position and which, on movement of the slide away from the third position after insertion of the fixed end of the flexible element, moves to a position in which it prevents movement of the slide back to the third position.

16. An electronic seal comprising a housing, a flexible element extending from the housing and having a free end which can be passed through a door catch, means for releasably connecting the free end of the flexible element to the housing, an electronic circuit within the housing arranged to generate one of a number of unique codes on receipt of an electrical signal and to store the generated code, display means on the housing adapted to display the generated code, and a switch on the housing actuated on connection or disconnection of the flexible element to the housing to provide an electrical signal to actuate the electronic circuit, in which the flexible element is a cord having a series of regularly spaced enlargements, and the means for releasably connecting the free end of the cord to the housing comprises a passage in the housing into which a length of the cord can be inserted, a plurality of teeth in the housing adapted to fit between enlargements of the cord, so that when the length of cord is inserted into the housing each enlargement of the length of cord can fit between two adjacent teeth to hold the cord against withdrawal from the housing, and a slide movable in the housing between a first position in which the cord can be inserted and removed from the passage, and a second position in which the slide retains the enlargements in engagement with the teeth, and the switch has an actuating member projecting between two of the teeth, so as to be engaged by one of the enlargements on the cord when it is engaged between the teeth, so that the switch is actuated when the length of cord is moved into or out of engagement with the teeth, and in which the fixed end of the flexible element is retained in the housing by engagement of the enlargements on a length of the flexible element at the fixed end of the flexible element with a further set of teeth formed on the slide, the further set of teeth engaging the enlargements when the slide is in each of the said first and second positions, and the slide being movable to a third position in which the teeth on the slide are withdrawn from engagement with the flexible element, so that the flexible element can be inserted into the housing.

* * * * *